US010178725B2

(12) United States Patent
Ko

(10) Patent No.: US 10,178,725 B2
(45) Date of Patent: Jan. 8, 2019

(54) ULTRA-HIGH EFFICIENCY LED LAMP DRIVING DEVICE AND DRIVING METHOD

(71) Applicant: Gowansoo Ko, Suwon-si (KR)

(72) Inventor: Gowansoo Ko, Suwon-si (KR)

(73) Assignee: GA CO., LTD., Wonju-Si (KR)

( * ) Notice: Subject to any disclaimer, the term of this patent is extended or adjusted under 35 U.S.C. 154(b) by 0 days.

(21) Appl. No.: 15/566,072

(22) PCT Filed: Apr. 15, 2016

(86) PCT No.: PCT/KR2016/003911

§ 371 (c)(1),
(2) Date: Oct. 12, 2017

(87) PCT Pub. No.: WO2016/167584

PCT Pub. Date: Oct. 20, 2016

(65) Prior Publication Data

US 2018/0139807 A1 May 17, 2018

(30) Foreign Application Priority Data

Apr. 17, 2015 (KR) ..... 10-2015-0054763

(51) Int. Cl.
*H05B 33/08* (2006.01)

(52) U.S. Cl.
CPC ..... *H05B 33/083* (2013.01); *H05B 33/0815* (2013.01); *H05B 33/0842* (2013.01)

(58) Field of Classification Search
None
See application file for complete search history.

(56) References Cited

U.S. PATENT DOCUMENTS

2007/0247084 A1* 10/2007 Zhao ..... H05B 39/045 315/291
2011/0115399 A1* 5/2011 Sadwick ..... H05B 33/0818 315/287
2014/0197749 A1* 7/2014 Yoon ..... H05B 33/083 315/191

FOREIGN PATENT DOCUMENTS

| | | |
|---|---|---|
| KR | 20070097060 | 10/2007 |
| KR | 100971759 | 7/2010 |
| KR | 101110380 | 2/2012 |
| KR | 20130003388 | 1/2013 |
| KR | 20130117133 | 10/2013 |
| KR | 20130119081 | 10/2013 |
| KR | 20140017752 | 2/2014 |

OTHER PUBLICATIONS

International Search Report—PCT/KR2016/003911 dated Aug. 19, 2016.

* cited by examiner

*Primary Examiner* — Jimmy Vu
*Assistant Examiner* — Laura Yesildag
(74) *Attorney, Agent, or Firm* — Cantor Colburn LLP

(57) ABSTRACT

Provided is an ultra-high efficiency LED lamp driving device comprising: a plurality of shift switches connected to tabs between LED lamps; and an LED shift control unit for driving the shift switches so that lighting of the LED lamps is shifted to an end terminal when a total operation threshold voltage value of the LED lamp is equal to or greater than a maximum value of an input voltage, and thus, an unlighted LED lamp exists. The present invention can make the power loss be zero to thereby increase the efficiency.

4 Claims, 7 Drawing Sheets

ULTRA-HIGH EFFICIENCY LED LAMP DRIVING DEVICE AND DRIVING METHOD

TECHNICAL FIELD

The present invention relates to an ultra-high efficiency light emitting diode (LED) lamp driving device and driving method, and more particularly, to an ultra-high efficiency LED lamp driving device and driving method that are capable of setting operating threshold voltages of all LED lamps so as to be equal to or higher than the maximum value of alternating current input voltage within the upper limit value in variation of the input voltage and are capable of shifting lighting of the LED lamps to the rear end of the LED lamps connected in series in order to light LED lamps that were not lit, thereby minimizing a loss in the voltage of the rear-end LED lamps and thus maximizing LED driving power efficiency.

BACKGROUND ART

In general, a light emitting diode (LED), which is a light source for an LED lamp, is a semiconductor configured to be driven by current. A current source is required in order to light the LED.

An alternating current (AC)-direct current (DC) converter system is well known as a system for driving such an LED lamp. However, the AC-DC converter system is a switching mode power supply system, the unit cost of which is about 25% the price of a product. That is, the AC-DC converter system is very expensive, which impedes the popularization of LED lamps. In order to solve this problem, an AC direct connection type LED lamp driving device, the price of which is extremely low, has been proposed as alternative technology.

FIG. 1 is a block diagram showing a general alternating current (AC) direct connection driving-type LED lamp driving device according to the conventional art.

As shown in FIG. 1, the general AC direct connection driving-type LED lamp driving device according to the conventional art includes a bridge diode 110 for converting AC input voltage from an AC input power source AC into full-wave rectified voltage, a plurality of LED lamps L1, . . . , and L7, which are loads that are configured to be lit by full-wave rectified voltage, which is output from the bridge diode 110, a first switch LW1 to a seventh switch LW7 for sequentially or non-sequentially driving the LED lamps L1, . . . , and L7 when the LED lamps L1, . . . , and L7 reach operating threshold voltages, and a switching controller 120 for controlling the switches LW1, . . . , and LW7 and a current source CS1.

Each of a first LED lamp L1, a second LED lamp L2, . . . , and a seventh LED lamp L7, which constitute the LED lamps L1, . . . , and L7, may be a single high-voltage LED lamp or a group of LEDs (an LED group).

Reference symbol CS1 indicates a current source CS1 for controlling input current and output current in the AC direct connection driving-type LED lamp driving device shown in FIG. 1.

The LED lamp driving operation that is performed by the general AC direct connection driving-type LED lamp driving device according to the conventional art having the above-stated construction will be described briefly.

When the instantaneous value of AC input voltage is higher than the operating threshold voltage $V_F$ of each LEP lamp as the result of an increase in the AC input voltage, the first LED lamp and the second LED lamp are sequentially lit.

That is, when AC input voltage that has been rectified increases from zero voltage and reaches the threshold voltage LED1 $V_F$ of the first LED lamp L1, the first LED operating switch LW1 is switched on, with the result that the first LED lamp L1 is lit. When the voltage continuously increases and reaches the threshold voltage LED2 $V_F$ of the second LED lamp L2, the second LED operating switch LW2 is switched on, with the result that the second LED lamp L2 is lit. When the voltage further continuously increases, the remaining switches are sequentially switched on, with the result that the remaining LED lamps are sequentially lit. In this way, all of the LED lamps are lit.

When the input voltage decreases after a phase of 90 degrees, the LED lamps are turned off one after another in the order that is reverse to the lighting sequence (in a non-sequential manner) or in the order that is the same as the lighting sequence (in a sequential manner).

Consequently, all of the LED lamps are lit at the rising time and the falling time of the input voltage.

However, the conventional AC direct connection driving-type LED lamp driving device has the following problems.

First, the efficiency of the AC direct connection driving system is basically about 10% lower than that of the SMPS system due to the characteristics of driving technology (input voltage variation and LED light-deviation output characteristics are required to be satisfied).

In controlling most AC direct connection driving systems, a plurality of LED lamp control tabs is provided, as shown in FIG. 1. As the number of control tabs increases, therefore, control efficiency is improved. However, the mitigation of a loss in the voltage of the rear-end LED lamps is limited due to the characteristics of driving technology (input voltage variation and LED light-deviation output characteristics are required to be satisfied), as described above, with the result that the efficiency of a general LED driver integrated circuit (IC) for controlling four groups is about 80%.

The input voltage of a conventional AC direct connection type driving circuit (device) varies depending on the nation (for example, 220 VAC in Korea and 260 VAC in Europe). In addition, there is variation in the input voltage. For example, variation in the input voltage in Korea is 10% of 220 VAC, and variation in the input voltage in Europe is 220 to 260 VAC.

When the input voltage varies, the total operating threshold voltages Total LED VF of the LED lamps, which are low fixed values, decrease in proportion to the magnitude of increase in input voltage. In the conventional art, when the input voltage varies, current is controlled to decrease. When the variation in the input voltage is excessive, the input voltage is cut in order to prevent an increase in input power. These operations are performed in order to complement driving reliability. In this case, however, driving power efficiency is greatly reduced. Consequently, the AC input voltage is limited to vary within a narrow variation range (about ±5% in the worst case). As a result, much power is lost, whereby efficiency is seriously reduced.

In addition, variation in input and optical characteristics with respect to variation in the AC input voltage is great and unstable.

Due to the characteristics of the AC direct connection driving system (variation in the input voltage and optical deviation between LED groups), for example, the total operating threshold voltages Total LED VF of the LED lamps must be set to be lower than the maximum voltage value Vmax, which is a value obtained by multiplying the lower limit value of variation in AC input voltage, which is 180 VAC, by √2 such that all of the LED lamps are lit, thereby achieving maximally uniform optical output.

As shown in FIG. 2, therefore, the total operating threshold voltages Total LED $V_F$ of the first LED lamp to the seventh LED lamp are set to be lower than the maximum voltage value Vmax. As a result, the loss in the voltage of the rear-end LED lamps is high due to the control characteristics of the AC direct connection driving type driver IC, whereby power efficiency is greatly reduced.

In particular, when the input voltage varies (increases), as shown in FIG. 2, a loss in the voltage of the rear-end LED lamps abruptly increases in proportion to the magnitude of increase in input voltage. As a result, LED lamp power efficiency is abruptly reduced in proportion to the increase in voltage.

This reduces not only efficiency but also greatly affects product reliability due to an increase in the amount of heat that is generated by the LED lighting device.

Consequently, it is required to improve such an inefficient part.

For example, it can be indirectly seen from simple calculation that, when the efficiency of 220 VAC is 80% and the input voltage varies to 264 VAC, 264/220=120%, and therefore the efficiency may be reduced to about 80%*0/8=64%.

Prior Patent Document 1: Korean Patent Application Publication No. 10-2007-0097060 (Oct. 2, 2007)

Prior Patent Document 2: Korean Registered Patent Publication No. 10-0971759 (Jul. 21, 2010)

DISCLOSURE

Technical Problem

The present invention has been made in order to solve the above problems of the conventional art, and the present invention provides an ultra-high efficiency LED lamp driving device and driving method capable of achieving the following objects.

It is a first object of the present invention to provide an ultra-high efficiency LED lamp driving device and driving method that are capable of shifting lighting of LED lamps connected in series and having operating threshold voltages equal to or higher than the maximum value Vmax [maximum Vrms*√2] of alternating current input voltage (voltage having the maximum variation range) to the rear end of the LED lamps connected in series, thereby making a loss in the voltage of the rear-end LED lamps zero and thus greatly improving the efficiency of driving of an AC direct connection driving-type LED lighting device.

It is a second object of the present invention to provide an ultra-high efficiency LED lamp driving device and driving method that are capable of minimizing a loss in the voltage of the rear-end LED lamps, which greatly increases when the alternating current input voltage varies (increases), thereby achieving wider input voltage characteristics and thus improving the stability and reliability of input and output characteristics.

It is a third object of the present invention to provide an ultra-high efficiency LED lamp driving device and driving method that are capable of increasing the number of LED lamps in consideration of variability of alternating current input voltage even when fluctuating voltage exceeding standard requirements is input, thereby realizing a large-capacity LED lighting device.

Technical Solution

In order to achieve the above objects, an ultra-high efficiency LED lamp driving device according to the present invention includes a rectification unit for rectifying alternating current input power, a plurality of LED lamps configured to be lit by the power rectified by the rectification unit, a plurality of operating switches connected to tabs between the LED lamps for sequentially lighting the LED lamps when voltages of the LED lamps reach driving threshold voltages as the voltage of the input power increases, a plurality of shift switches connected to tabs between the LED lamps, and a LED shift controller for operating the shift switches such that, when operating threshold voltage values of all of the LED lamps are equal to or higher than a maximum value of input voltage of the alternating current input power and thus there are LED lamps that were not lit during a voltage rising time of rectified voltage or during a first cycle of alternating cycles of the rectified voltage, a number of front-end LED lamps equal to the number of rear-end LED lamps that were not lit during the voltage rising time or during the first cycle of the alternating cycles are skipped in the rear-end direction, whereby lighting of the LED lamps is shifted to a rear end of the LED lamps connected in series during a voltage falling time or during a second cycle of the alternating cycles in order to sequentially light LED lamps ranging from the rear-end LED lamps that were not lit during the voltage rising time or during the first cycle to LED lamps corresponding to an instantaneous value of the input voltage.

In the ultra-high efficiency LED lamp driving device according to the present invention, the LED shift controller may include a trigger output unit for sensing a trigger voltage value of the input voltage and outputting a trigger signal and an LED shift unit for skipping a number of front-end LED lamps corresponding to the number of rear-end LED lamps that were not lit at the voltage rising time or at the second cycle of the alternating cycles in the rear-end direction such that lighting of the LED lamps is shifted to the rear end of the LED lamps connected in series when the trigger signal is received from the trigger output unit and when the operating threshold voltage values of all of the LED lamps are equal to or higher than the maximum value of the input voltage of the alternating current input power and thus there is at least one LED lamp that was not lit beginning from the rearmost LED lamp in order to sequentially light LED lamps ranging from the rear-end LED lamps that were not lit during the voltage rising time according to a cycle of the rectified voltage or during the first cycle of the alternating cycles of the rectified voltage to LED lamps corresponding to the instantaneous value of the input voltage.

In the ultra-high efficiency LED lamp driving device according to the present invention, the trigger output unit may sense the maximum value of the input voltage and output a trigger signal, and the LED shift unit may operate the shift switches to skip at least one front-end LED lamp during the voltage falling time such that lighting of the LED lamps is shifted to the rear end thereof when the trigger signal is received from the trigger output unit and when the operating threshold voltage values of all of the LED lamps are equal to or higher than the maximum value of the input voltage of the alternating current input power in order to light the LED lamps that were not lit during the voltage rising time according to a cycle of the rectified voltage.

In the ultra-high efficiency LED lamp driving device according to the present invention, the trigger output unit may sense a zero voltage value of the input voltage and output a trigger signal, and the LED shift unit may operate the shift switches during the second cycle of alternating cycles such that lighting of the LED lamps is shifted to the rear end thereof when the trigger signal is received from the trigger output unit and when the operating threshold voltage values of all of the LED lamps are equal to or higher than the maximum value of the input voltage of the alternating current input power in order to light the LED lamps that were not lit during the first cycle of the alternating cycles of the rectified voltage.

The ultra-high efficiency LED lamp driving device according to the present invention may further include a rear-end voltage monitoring unit for monitoring a rear-end voltage of the LED lamp that is located at the rearmost end of the LED lamps and outputting monitored rear-end voltage to the LED shift unit, wherein, when the rear-end voltage detected by the rear-end voltage monitoring unit is equal to or higher than a reference voltage value, the LED shift unit may delay shifting for a predetermined amount of time.

In order to achieve the above objects, an ultra-high efficiency LED lamp driving method according to the present invention includes a step of sequentially lighting a number of LED lamps corresponding to an instantaneous value of input voltage beginning from a front-end LED lamp during a voltage rising time as full-wave rectified voltage increases, a step of, during a falling time, during which voltage decreases after a maximum voltage value, skipping a number of front-end LED lamps equal to the number of rear-end LED lamps that were not lit during the voltage rising time in the rear-end direction such that lighting of the LED lamps is shifted to the rear end of the LED lamps connected in series in order to sequentially light the LED lamps ranging from the rear-end LED lamps that were not lit during the voltage rising time to the LED lamps corresponding to the instantaneous value of the input voltage, and a step of sequentially shifting the lighting of the LED lamps in the rear-end direction in proportion to the magnitude of decrease in input voltage in order to light the LED lamps.

In order to achieve the above objects, an ultra-high efficiency LED lamp driving method according to the present invention includes a step of, during a first cycle of alternating cycles of full-wave rectified alternating current input voltage, lighting a number of LED lamps corresponding to an instantaneous value of the input voltage that increases and decreases beginning from the front end of the LED lamps, a step of, during a second cycle of the alternating cycles of the full-wave rectified alternating current input voltage, skipping a number of front-end LED lamps corresponding to the number of rear-end LED lamps that were not lit at the first cycle of the alternating cycles in the rear-end direction in order to shift lighting of the LED lamps to the rear end of the LED lamps connected in series such that a number of LED lamps corresponding to the instantaneous value of the input voltage that increases and decreases beginning from the rear-end LED lamps that were not lit at the first cycle are lit, and a step of sequentially shifting lighting of the LED lamps in the rear-end direction in proportion to the magnitude of increase and decrease in input voltage and lighting the LED lamps.

Advantageous Effects

The ultra-high efficiency LED lamp driving device and driving method according to the present invention having the above-stated construction have the following effects.

First, the loss in the voltage of rear-end LED lamps is very small, with the result that the efficiency of driving of the LED lamps is increased to 95% or more.

Second, the loss of power is very small even when input voltage varies, with the result that efficiency is improved.

Third, the present invention has very uniform high-efficiency input and output characteristics even when alternating current input voltage varies, with the result that energy saving efficiency becomes about 5% higher than that of an SMPS system, which is a general system that is currently being sold in the market.

Fourth, the present invention may satisfy ratings (a prescribed range of voltage that is used) or requirements, thereby providing wider input voltage variation characteristics. Consequently, very stable characteristics and high reliability can be achieved even in the case in which input power is unstable.

Fifth, it is possible to increase the number of LED lamps in consideration of reliability in an input variable value. Consequently, the present invention is capable of being very easily applied to an ultra-large capacity LED lighting device. In particular, the cost of manufacturing a middle- or large-sized lighting device can be reduced.

Sixth, it is also possible to acquire optical output having minimized deviation between LED lamps or between LED groups, whereby the application of the present invention is not limited. In particular, the present invention is capable of being applied to a linear-type LED lighting device (LED TUBE_FLUOROSCENCE TYPE) and a planar LED lighting device.

BEST MODE

Figure 1:
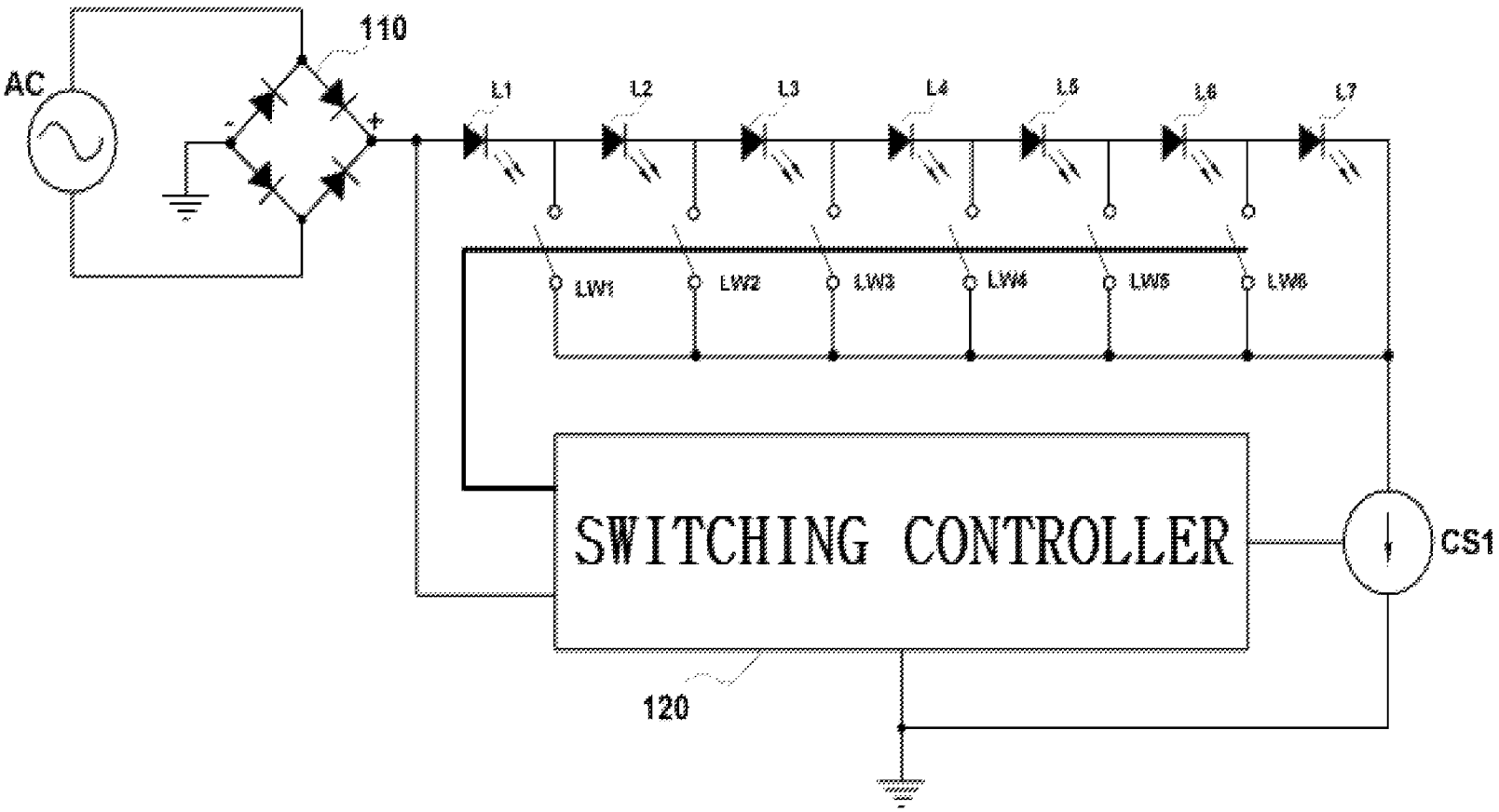
FIG. 1 Prior Art
FIG. 1 is a block diagram showing a conventional AC direct connection driving-type LED lighting device.
Figure 2:
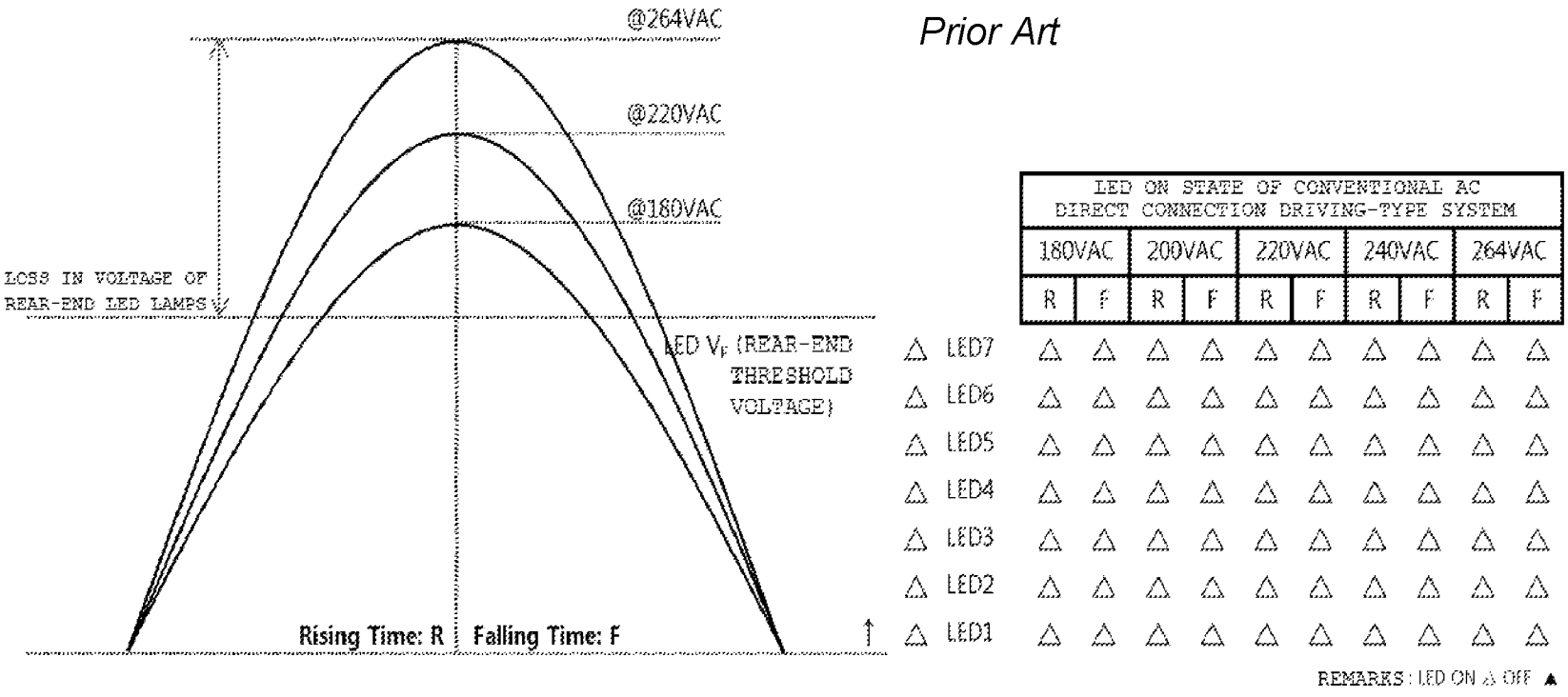
FIG. 2 Prior Art
FIG. 2 is a conceptual view showing a loss in the voltage of rear-end LED lamps of the conventional AC direct connection driving-type LED lighting device and a view showing an LED ON state.
Figure 3:
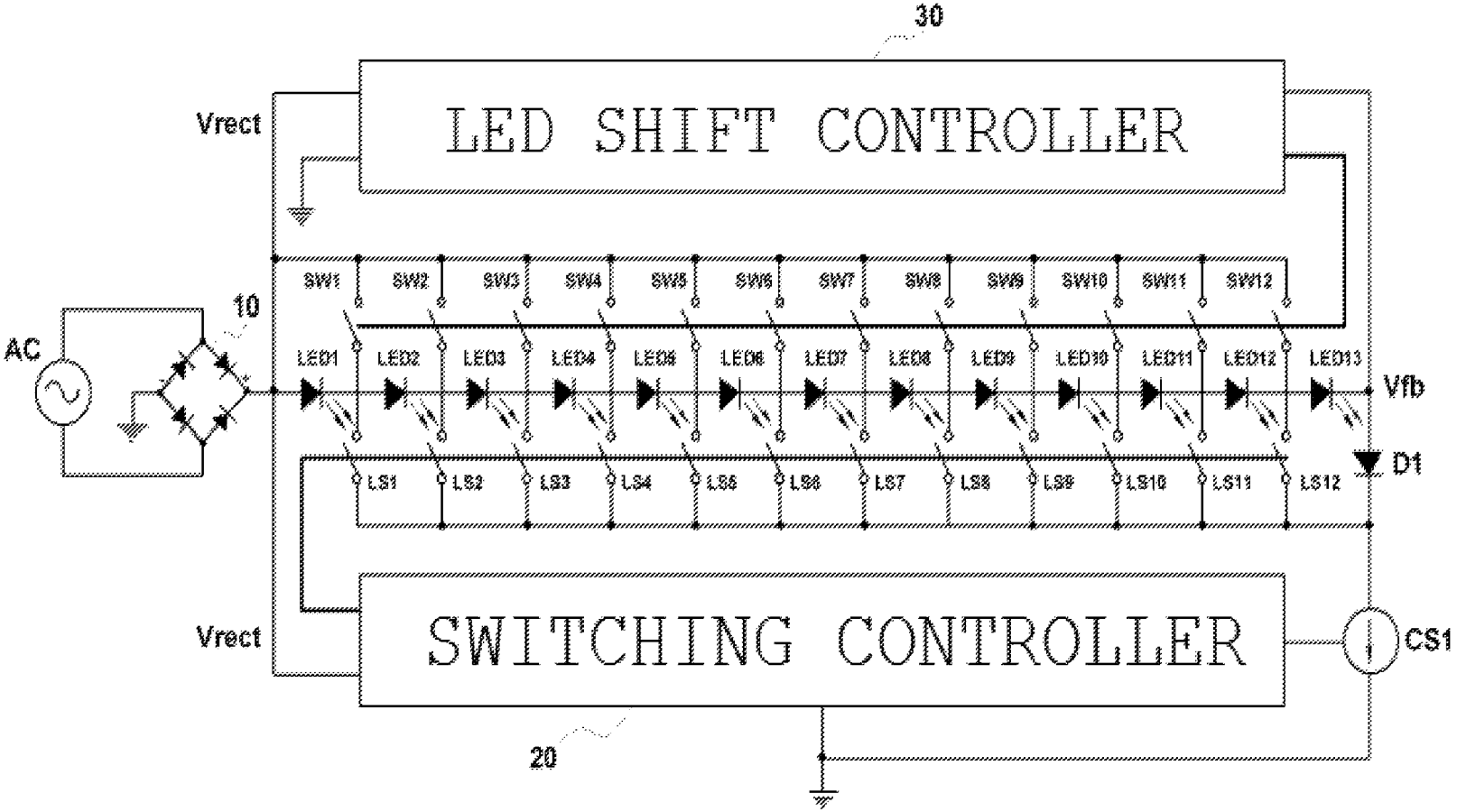
FIG. 3 is a block diagram showing an ultra-high efficiency LED lighting device according to an embodiment of the present invention.
Figure 4:
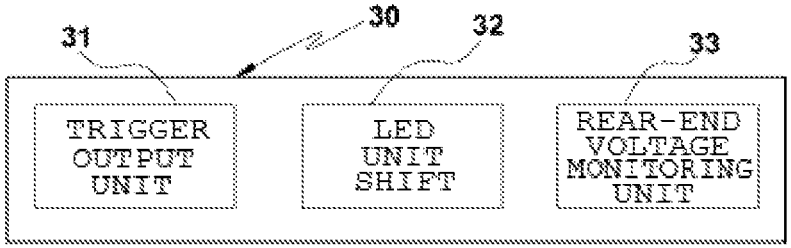
FIG. 4 is a detailed block diagram showing an LED shift control unit 30 in FIG. 3.

Hereinafter, the preferred embodiments of an ultra-high efficiency LED lamp driving device and driving method according to the present invention will be described with reference to the accompanying drawings.

As shown, an ultra-high efficiency LED lamp driving device according to an embodiment of the present invention includes a rectification unit 10, a plurality of LED lamps LED1, . . . , and LED13, a plurality of operating switches LS1, . . . , and LS12, a plurality of shift switches SW1, . . . , and SW12, and an LED shift controller 30.

The rectification unit 10 is an element for rectifying input AC power. The rectification unit 10 may include, for example, a bridge diode.

The LED lamps LED1, . . . , and LED13 are light sources that are lit by the power rectified by the rectification unit 10.

The LED lamps LED1, . . . , and LED13 may include, for example, a first LED lamp LED1, a second LED lamp LED2, a third LED lamp LED3, . . . , and a thirteenth LED lamp LED13. Each of the LED lamps LED1, . . . , and LED13 may be a single high-voltage LED lamp (HV-LED lamp) or a group of LEDs. In this embodiment, 13 LED lamps or 13 groups of LEDs are described by way of example. However, the number of LED lamps or the number of groups of LEDs is not limited thereto.

The operating switches LS1, . . . , and LS12 are connected to tabs between the LED lamps LED1, . . . , and LED13, and sequentially light the LED lamps LED1, . . . , and LED13 when the voltages of the LED lamps LED1, . . . , and LED13 reach driving threshold voltages as the voltage of an input power source increases.

The shift switches SW1, . . . , and SW12 are connected to tabs between the LED lamps LED1, . . . , and LED13.

The LED shift controller 30 operates the shift switches such that, when the operating threshold voltage values of all of the LED lamps LED1, . . . , and LED13 are equal to or higher than the maximum value Vmax of the input voltage of input AC power and thus there are LED lamps that were not lit during a voltage rising time of rectified voltage or during a first cycle of alternating cycles of the rectified voltage, front-end LED lamps are skipped in the rear-end direction by the number of rear-end LED lamps that were not lit during the voltage rising time or during the first cycle of the alternating cycles, whereby lighting of the LED lamps is shifted to the rear end of the LED lamps connected in series during a voltage falling time or during a second cycle of the alternating cycles in order to sequentially light LED lamps ranging from the rear-end LED lamps that were not lit during the voltage rising time or during the first cycle to LED lamps corresponding to the instantaneous value of the input voltage.

In another embodiment, a switching controller 20 may be further included.

The switching controller 20 senses whether voltage input to the LED lamps LED1, . . . , and LED13 increases and reaches the operating threshold voltage of each of the LED lamps, and, when the input voltage reaches the operating threshold voltage of each of the LED lamps, outputs a switching signal for operating an operating switch connected to each LED lamp or performs control such that the operating threshold voltages are applied to the LED lamps LED1, . . . , and LED13 in order to switch on or off the operating switches.

In the ultra-high efficiency LED lamp driving device according to the embodiment of the present invention, the LED shift controller 30 includes a trigger output unit 31 for sensing a trigger voltage value of the input voltage [the maximum voltage value (a voltage value having a phase angle of 90 degrees) or a zero voltage value Vmin] and outputting a trigger signal and an LED shift unit 32 for skipping at least one LED lamp [for example, a number of front-end LED lamps corresponding to the number of rear-end LED lamps that were not lit] in the rear-end direction during a voltage falling time or during a second cycle of the alternating cycles such that lighting of the LED lamps is shifted to the rear end of the LED lamps connected in series when the trigger signal is received from the trigger output unit 31 and when the total operating threshold voltages of the LED lamps LED1, . . . , and LED13 are equal to or higher than the maximum value Vmax of the input voltage of the input AC power and thus there is at least one LED lamp that was not lit beginning from the rearmost LED lamp in order to sequentially light the LED lamps ranging from the rear-end LED lamps that were not lit during the voltage rising time according to a cycle of the rectified voltage or during the first cycle of the alternating cycles of the rectified voltage to the LED lamps corresponding to the instantaneous value of the input voltage.

In the ultra-high efficiency LED lamp driving device according to the embodiment of the present invention, a rear-end voltage monitoring unit 33 for monitoring the rear-end voltage of the LED lamp LED13, which is located at the rearmost end of the LED lamps LED1, . . . , and LED13, and outputting monitored rear-end voltage Vfb to the LED shift unit 32 is further included. When the rear-end voltage Vfb detected by the rear-end voltage monitoring unit 33 is equal to or higher than a reference voltage value Vref, the LED shift unit 32 delays shifting.

In an ultra-high efficiency LED lamp driving device according to a first embodiment of the present invention, the trigger output unit 31 senses the maximum value of the input voltage (a voltage value having a phase angle of 90 degrees) and outputs a trigger signal, and the LED shift unit 32 operates the shift switches to skip at least one front-end LED lamp during the voltage falling time such that lighting of the LED lamps is shifted to the rear end thereof when the trigger signal is received from the trigger output unit 31 and when the total operating threshold voltages of the LED lamps LED1, . . . , and LED13 are equal to or higher than the maximum value Vmax of the input voltage of the input AC power in order to light the LED lamps that were not lit during the voltage rising time according to a cycle of the rectified voltage.

In an ultra-high efficiency LED lamp driving device according to a second embodiment of the present invention, the trigger output unit 31 senses the zero voltage value Vmin of the input voltage and outputs a trigger signal, and the LED shift unit 32 operates the shift switches during the second cycle of alternating cycles of the rectified voltage such that lighting of the LED lamps is shifted to the rear end thereof when the trigger signal is received from the trigger output unit 31 and when the total operating threshold voltages of the LED lamps are equal to or higher than the maximum value Vmax of the input voltage of the input AC power in order to light the LED lamps that were not lit during the first cycle of the alternating cycles of the rectified voltage.

Hereinafter, an ultra-high efficiency LED lamp driving method will be described.

The case in which AC input voltage varies, for example, the case in which Vin=180 VAC, Vin=200 VAC, Vin=220 VAC, Vin=240 VAC, and Vin=264 VAC will be described by way of example.

In the ultra-high efficiency LED lamp driving device according to the embodiment of the present invention, the total operating threshold voltages Total LED VF of the LED lamps are set to be equal to or higher than the maximum value Vmax of the AC input voltage within the upper limit value in variation of the input voltage.

The maximum value Vmax of the input voltage=Vin*√2 [which can be simplified as $\sqrt{2}$, which is used throughout this specification]. Since the variation of the AC input voltage is 180, 200, 220, 240, and 264 VAC in the above example, the input voltage within the upper limit value in variation thereof is 264 VAC. Consequently, setting is performed such that the total operating threshold voltages Total LED VF of the LED lamps ≥264 VAC*√2.

At this time, the total number of LED lamps must be equal to or greater than the maximum value Vmax of the input voltage/LED $V_F$ (the operating threshold voltage of each LED lamp).

When the setting is performed as described above, a loss in the voltage of the rear-end LED lamps due to an increase in voltage does not increase within the variation range of the AC input voltage.

For example, on the assumption that the total operating threshold voltages of the LED lamps are set to 264 VAC*√2 and common LED lamp operating voltage is considered, thirteen LED lamps or thirteen LED group lamps including a first LED lamp LED1 to a thirteenth LED lamp LED13 will be described by way of example.

First, a method of performing shift lighting of the LED lamps at a falling time of the input voltage according to a first embodiment of the present invention will be described.

AC power from the AC input power source AC is full-wave rectified by the rectification unit 10, and as the full-wave rectified voltage increases, a number of LED lamps corresponding to the instantaneous value of input voltage beginning from the front-end LED lamp are sequentially lit during a voltage rising time.

Figure 5:
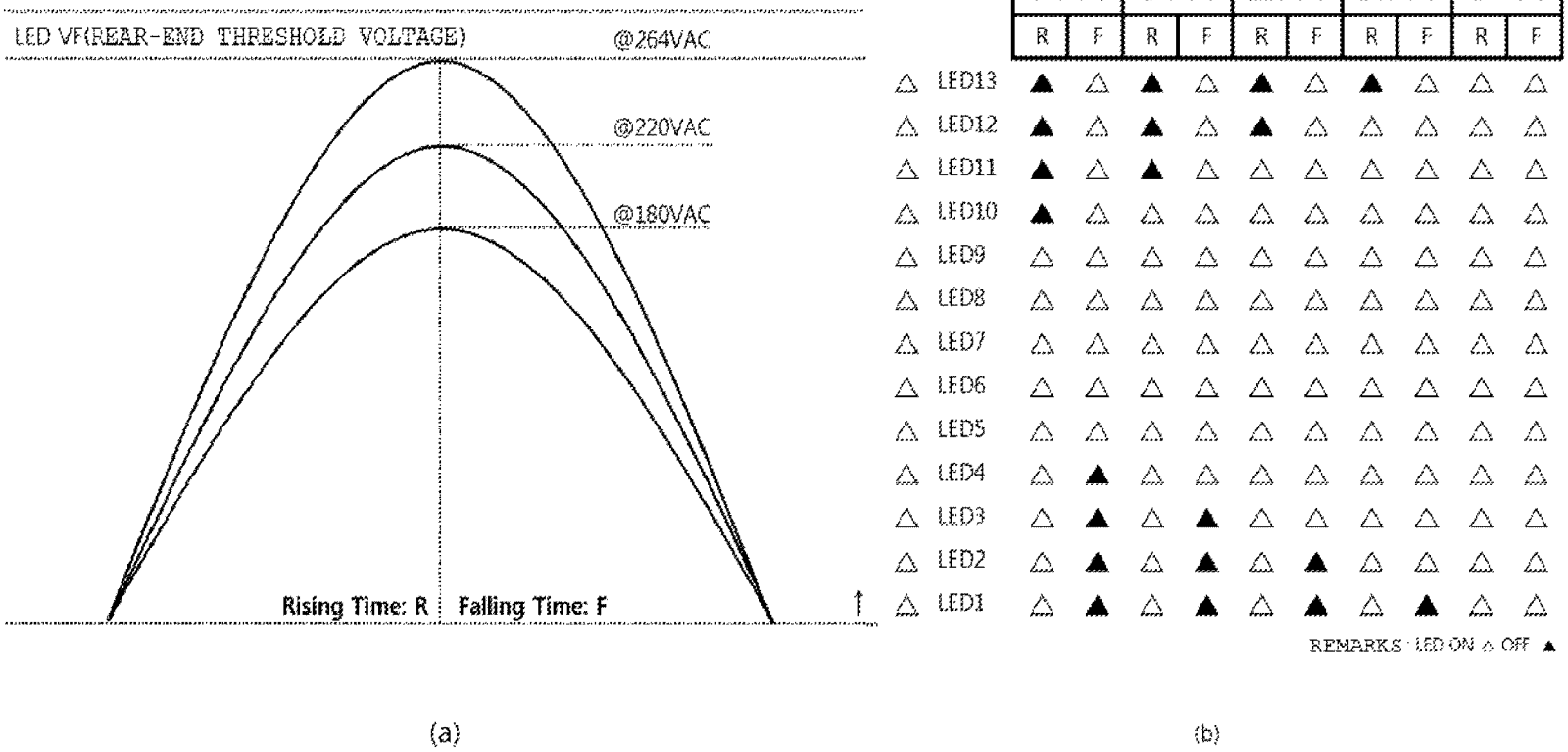
FIG. 5 is a conceptual view showing that a loss in the voltage of rear-end LED lamps becomes zero in a certain cycle in a first embodiment of the present invention [(a) of FIG. 5] and an explanatory view showing LED lamp ON and OFF states at a rising time and a falling time in a certain cycle [(b) of FIG. 5]

When the instantaneous value of input voltage is higher than the operating threshold voltage $V_F$ of each of the LED lamps LED1, . . . , and LED13, which are connected to each other in series, as the AC input voltage increases, the LED lamps ranging from the first LED lamp LED1 to the LED lamps corresponding to the maximum value Vmax of the input voltage (Vmax=Vin*√2) are sequentially lit. As shown in FIG. 5, the LED lamps adjacent in the rear-end direction are not lit depending on the input voltage value.

Specifically, when the full-wave rectified AC input voltage increases from zero and reaches the threshold voltage LED1 $V_F$ of the first LED lamp LED1, the first operating switch LS1 is switched on such that the first LED lamp LED1 emits light. When the voltage continuously increases and reaches the threshold voltage LED2 $V_F$ of the second LED lamp LED2, the second operating switch LS2 is switched on such that the second LED lamp LED2 emits light. When the voltage increases and reaches the threshold voltages of the LED lamps, as described above, the operating switches connected to the tabs of the LED lamps are switched on such that the LED lamps emit light. Since the total operating threshold voltages Total LED VF of the LED lamps are set to be equal to or higher than the maximum value Vmax of the AC input voltage within the upper limit value in variation of the input voltage, there may be LED lamps that are not lit.

When the input voltage is 180 VAC (@180 VAC), as shown in FIG. 5, the operating switches ranging from the first operating switch LS1 to the ninth operating switch LS9 operate to light the LED lamps ranging from the first LED lamp LED1 to the ninth LED lamp LED9, and the remaining LED lamps, i.e. the LED lamps ranging from the tenth LED lamp LED10 to the thirteenth LED lamp LED13, are not lit.

When the input voltage is 200 VAC (@200 VAC), the operating switches ranging from the first operating switch LS1 to the tenth operating switch LS10 operate to light the LED lamps ranging from the first LED lamp LED1 to the tenth LED lamp LED10, and the remaining LED lamps, i.e. the eleventh LED lamp LED11 to the thirteenth LED lamp LED13, are not lit. When the input voltage is 220 VAC (@220 VAC), the operating switches ranging from the first operating switch LS1 to the eleventh operating switch LS11 operate to light the LED lamps ranging from the first LED lamp LED1 to the eleventh LED lamp LED11, and the remaining LED lamps, i.e. the LED lamps ranging from the twelfth LED lamp LED12 and the thirteenth LED lamp LED13, are not lit. When the input voltage is 240 VAC (@240 VAC), the operating switches ranging from the first operating switch LS1 to the twelfth operating switch LS12 operate to light the LED lamps ranging from the first LED lamp LED1 to the twelfth LED lamp LED12, and the thirteenth LED lamp LED13 is not lit.

Meanwhile, in FIG. 5, when the input voltage is 264 VAC (@264 VAC), the operating switches ranging from the first operating switch LS1 to the twelfth operating switch LS12 operate to light all of the LED lamps LED1, . . . , and LED13, i.e. the LED lamps ranging from the first LED lamp LED1 to the thirteenth LED lamp LED13. If the total operating threshold voltages Total LED VF of the LED lamps are set to be higher than 264 VAC*√2, there may be LED lamps that were not lit. Therefore, more than thirteen LED lamps may be needed in consideration of the number of LED lamps that are not lit.

Now, the operation during a falling time, during which the input voltage decreases after the maximum value Vmax of the input voltage, will be described.

During a falling time, during which the input voltage decreases after the maximum value Vmax of the input voltage, a step (S72) of skipping a number of front-end LED lamps equal to the number of rear-end LED lamps that were not lit during the voltage rising time in the rear-end direction such that lighting of the LED lamps is shifted to the rear end of the LED lamps connected in series in order to sequentially light the LED lamps ranging from the rear-end LED lamps that were not lit during the voltage rising time to the LED lamps corresponding to the instantaneous value of the input voltage is performed.

That is, when the AC input voltage decreases after the high point, i.e. the maximum voltage value Vmax, lighting of the LED lamps is shifted to the rear end of the LED lamps, whereby the LED lamps ranging from the rear-end LED lamp, i.e. the thirteenth LED lamp LED13, to the LED lamp corresponding to the maximum value Vmax of the input voltage (Vmax=Vin*√2) are lit.

For example, when the input voltage is 180 VAC (@180 VAC), the LED shift controller 30 shifts lighting of the LED lamps to the rear-end LED lamp, i.e. the thirteenth LED lamp LED13, such that the LED lamps ranging from the rear-end LED lamp, i.e. the thirteenth LED lamp LED13, to the LED lamp corresponding to the maximum value Vmax of the input voltage (Vmax=180*√2), i.e. the fifth LED lamp LED5, are lit and such that the remaining LED lamps, i.e. the LED lamps ranging from the fourth LED lamp LED4 to the first LED lamp LED1, are not lit.

When the input voltage is 200 VAC (@200 VAC), the LED shift controller 30 shifts lighting of the LED lamps to the rear-end LED lamp, i.e. the thirteenth LED lamp LED13, such that the LED lamps ranging from the rear-end LED lamp, i.e. the thirteenth LED lamp LED13, to the LED lamp corresponding to the maximum value Vmax of the input voltage (Vmax=200*√2), i.e. the fourth LED lamp LED4, are lit and such that the remaining LED lamps, i.e. the LED lamps ranging from the third LED lamp LED3 to the first LED lamp LED1, are not lit.

In the same manner, when the input voltage is 220 VAC (@220 VAC), the LED lamps ranging from the rear-end LED lamp, i.e. the thirteenth LED lamp LED13, to the LED lamp corresponding to the maximum value Vmax of the input voltage (Vmax=220*√2), i.e. the third LED lamp LED3, are lit and such that the remaining LED lamps, i.e. the second LED lamp LED2 and the first LED lamp LED1, are not lit. In addition, when the input voltage is 240 VAC (@240 VAC), the LED lamps ranging from the rear-end LED lamp, i.e. the thirteenth LED lamp LED13, to the LED lamp corresponding to the maximum value Vmax of the input voltage (Vmax=240*√2), i.e. the second LED lamp LED2, are lit and such that the remaining LED lamp, i.e. the first LED lamp LED1, is not lit.

As shown in FIG. 5, therefore, it can be seen that there are LED lamps that are not lit depending on the input voltage value. The reason for this is that the total operating threshold voltages Total LED VF of the LED lamps are set to be equal to or higher than the maximum value Vmax of the AC input voltage within the upper limit value in variation of the input voltage in order to make LED driving loss zero, as described above.

Therefore, the first embodiment of the present invention is characterized in that LED lamps that are not lit when voltage increases are lit when voltage decreases and in that LED lamps that are not lit when voltage decreases are lit when voltage increases.

Now, the control operation during a falling time will be described in detail.

When the maximum value of the input voltage has been reached, the trigger output unit 31 senses the same and outputs a trigger signal to the LED shift unit 32.

Upon receiving the trigger signal from the trigger output unit 31, the LED shift unit 32 outputs a switching signal to the shift switches and at the same time receives the rear-end voltage Vfb of the rear-end LED lamp, i.e. the thirteenth LED lamp LED13, from the rear-end voltage monitoring unit 33.

Upon receiving the trigger signal, the LED shift unit 32 operates the shift switches. For example, the LED shift unit 32 sequentially outputs a switching signal to the shift switches beginning from the first shift switch SW1 in the rear-end direction in order to sequentially operate the shift switches. When the rear-end voltage Vfb is lower than the reference voltage value Vref (for example, 0.2 V) in the switching process, the next shift switch in the rear-end direction is sequentially switched on in order to perform shift lighting of a corresponding one of the LED lamps.

If the rear-end voltage Vfb, which is a monitored voltage value, is not detected [if the rear-end voltage Vfb is lower than the reference voltage value Vref], the shift switches are switched at a very fast speed without delay. If the detected rear-end voltage Vfb is equal to or higher than the reference voltage value Vref (for example, 0.2 V), control is performed such that a time at which the next shift switch is switched on is delayed. That is, a time interval during which the corresponding shift switch remains on is maintained long such that the lit state of the corresponding LED lamp is maintained for a predetermined interval.

For example, when the input voltage is 180 VAC (@180 VAC), the LED shift unit 32 sequentially outputs a switching signal to the first shift switch SW1→the second shift switch SW2→the third shift switch SW3 in order to sequentially switch on the first shift switch SW1, the second shift switch SW2, and the third shift switch SW3. Since the rear-end voltage Vfb equal to or higher than the reference voltage value is not detected, however, the LED shift unit 32 switches the first shift switch SW1→the second shift switch SW2→the third shift switch SW3 at a very fast speed (for example, a few us) without delay. At this time, the first, second, and third LED lamps LED1, LED2, and LED3, which are connected to the switched first, second, and third shift switches SW1, SW2, and SW3, are not lit, and are thus skipped.

When the LED shift unit 32 outputs a switching signal to the fourth shift switch SW4 and thus the fourth shift switch SW4 is switched on, lighting of the LED lamps is shifted in the rear-end direction, with the result that the LED lamps ranging from the rear-end LED lamp, i.e. the thirteenth LED lamp LED13, to the LED lamp corresponding to the maximum value Vmax of the input voltage (Vmax=180*√2), i.e. the fifth LED lamp LED5, are lit, and the remaining LED lamps, i.e. the LED lamps ranging from the fourth LED lamp LED4 to the first LED lamp LED1, are not lit.

When the fourth shift switch SW4 is switched on and thus the LED lamps ranging from the thirteenth LED lamp LED13 to the fifth LED lamp LED5 are lit, the rear-end voltage value Vfb equal to or higher than the reference voltage value Vref is detected, and, upon receiving the rear-end voltage value, the LED shift unit 32 delays switching to the next shift switch [in this case, the fifth shift switch SW5] in order to maintain the state in which the fourth shift switch SW4 is on while the rear-end voltage value Vfb remains equal to or higher than the reference voltage value Vref.

Switching of the shift switches is delayed due to a decrease in the input voltage, and substantial light emission is achieved through such switching delay.

In addition, when the input voltage is 200 VAC (@200 VAC), the LED shift unit 32 sequentially outputs a switching signal to the first shift switch SW1 and the second shift switch SW2. Since the monitored voltage value is not detected, however, the LED shift unit 32 skips the first shift switch SW1 and the second shift switch SW2 at a very fast speed. When the LED shift unit 32 sequentially outputs a switching signal to the third shift switch SW3, the third shift switch SW3 is switched on and lighting of the LED lamps is shifted in the rear-end direction. As a result, the LED lamps ranging from the rear-end LED lamp, i.e. the thirteenth LED lamp LED13, to the LED lamp corresponding to the maximum value Vmax of the input voltage (Vmax=200*√2), i.e. the fourth LED lamp LED4, are lit, and the remaining LED lamps, i.e. the LED lamps ranging from the third LED lamp LED3 to the first LED lamp LED1, are not lit.

In the same manner, when the input voltage is 220 VAC (@220 VAC), lighting of the LED lamps is shifted in the rear-end direction, with the result that the LED lamps ranging from the thirteenth LED lamp LED13 to the third LED lamp LED3 are lit. In addition, when the input voltage is 240 VAC (@240 VAC), lighting of the LED lamps is shifted in the rear-end direction, with the result that the LED lamps ranging from the thirteenth LED lamp LED13 to the second LED lamp LED2 are lit.

As described above, a step (S74) of lighting an initial LED lamp according to shift lighting control during the falling time and sequentially shifting the lighting of the LED lamps in the rear-end direction in proportion to the magnitude of decrease in input voltage in order to light the LED lamps is performed, which will be described hereinafter in detail.

When the input voltage decreases after lighting of the LED lamps is shifted in the rear-end direction from the initial LED lamp, the monitored rear-end voltage Vfb becomes lower than the reference voltage value Vref (0.2 V in the above example).

At this time, when the voltage value, of which the monitored rear-end voltage value is lower than the reference voltage value Vref, is detected, the LED shift unit 32 sequentially outputs a switching signal to the next shift switch in order to sequentially perform shift lighting of the LED lamps.

For example, when the input voltage is 180 VAC (@180 VAC), the LED shift unit 32 outputs a switching signal to the switch next to the initial fourth shift switch SW4 in the rear-end direction, i.e. the fifth shift switch SW5. At this time, the fifth shift switch SW5 is switched on and lighting of the LED lamps is shifted in the rear-end direction. As a result, the LED lamps ranging from the rear-end LED lamp, i.e. the thirteenth LED lamp LED13, to the LED lamp having the threshold driving voltage value corresponding to the instantaneous value of the input voltage when the fifth shift switch SW5 is switched on, i.e. the sixth LED lamp LED6, are lit, and the remaining LED lamps, i.e. the LED lamps ranging from the fifth LED lamp LED5 to the first LED lamp LED1, are not lit.

At this time, when the fifth shift switch SW5 is switched on and the LED lamps ranging from the thirteenth LED lamp LED13 to the fifth LED lamp LED5, the rear-end voltage value is detected. Upon receiving the monitored rear-end voltage value, the LED shift unit 32 performs control to delay the operation of the fifth shift switch SW5 for a predetermined switching on duration time, in the same manner as described above.

When the input voltage further decreases and the monitored rear-end voltage Vfb becomes lower than the reference voltage value Vref (0.2 V in the above example), the next shift lighting of the LED lamps is performed. When the input voltage is 180 VAC (@180 VAC), the LED shift unit outputs a switching signal to the switch next to the previously operated shift switch, i.e. the fifth shift switch SW5, in the rear-end direction, i.e. the sixth shift switch SW6. At this time, the sixth shift switch SW6 is switched on and lighting of the LED lamps is shifted in the rear-end direction. As a result, the LED lamps ranging from the rear-end LED lamp, i.e. the thirteenth LED lamp LED13, to the LED lamp having the threshold driving voltage value corresponding to the instantaneous value of the input voltage when the sixth shift switch SW6 is switched on, i.e. the seventh LED lamp LED7, are lit, and the remaining LED lamps, i.e. the LED lamps ranging from the sixth LED lamp LED6 to the first LED lamp LED1, are not lit.

The shift lighting operation is repeated. When the seventh shift switch SW7 is switched on, the LED lamps ranging from the thirteenth LED lamp LED13 to the eighth LED lamp LED8 are lit. When the eighth shift switch SW8 is switched on, the LED lamps ranging from the thirteenth LED lamp LED13 to the ninth LED lamp LED9 are lit. When the ninth shift switch SW9 is switched on, the LED lamps ranging from the thirteenth LED lamp LED13 to the tenth LED lamp LED10 are lit. When the tenth shift switch SW10 is switched on, the LED lamps ranging from the thirteenth LED lamp LED13 to the eleventh LED lamp LED11 are lit. When the eleventh shift switch SW11 is switched on, the thirteenth LED lamp LED13 and the twelfth LED lamp LED12 are lit. When the twelfth shift switch SW12 is switched on, the thirteenth LED lamp LED13 is lit.

When the input voltage is 200 VAC (@200 VAC), 220 VAC (@220 VAC), or 240 VAC (@240 VAC), sequential shift lighting is performed according to the same principle.

As can be seen from the above-described operation, the amount of current that flows in the LED lamps gradually decreases in the rear-end direction, since the current has the characteristics of an AC voltage waveform (sine wave) due to AC voltage characteristics and PF/THD-I characteristics. As a result, it is also possible to minimize the difference between average amounts of current that flow in the LED lamps through shift lighting of the LED lamps described above.

Next, a method of performing shift lighting of the LED lamps at a second cycle of alternating cycles of full-wave rectified voltage according to a second embodiment of the present invention will be described.

Figure 6:
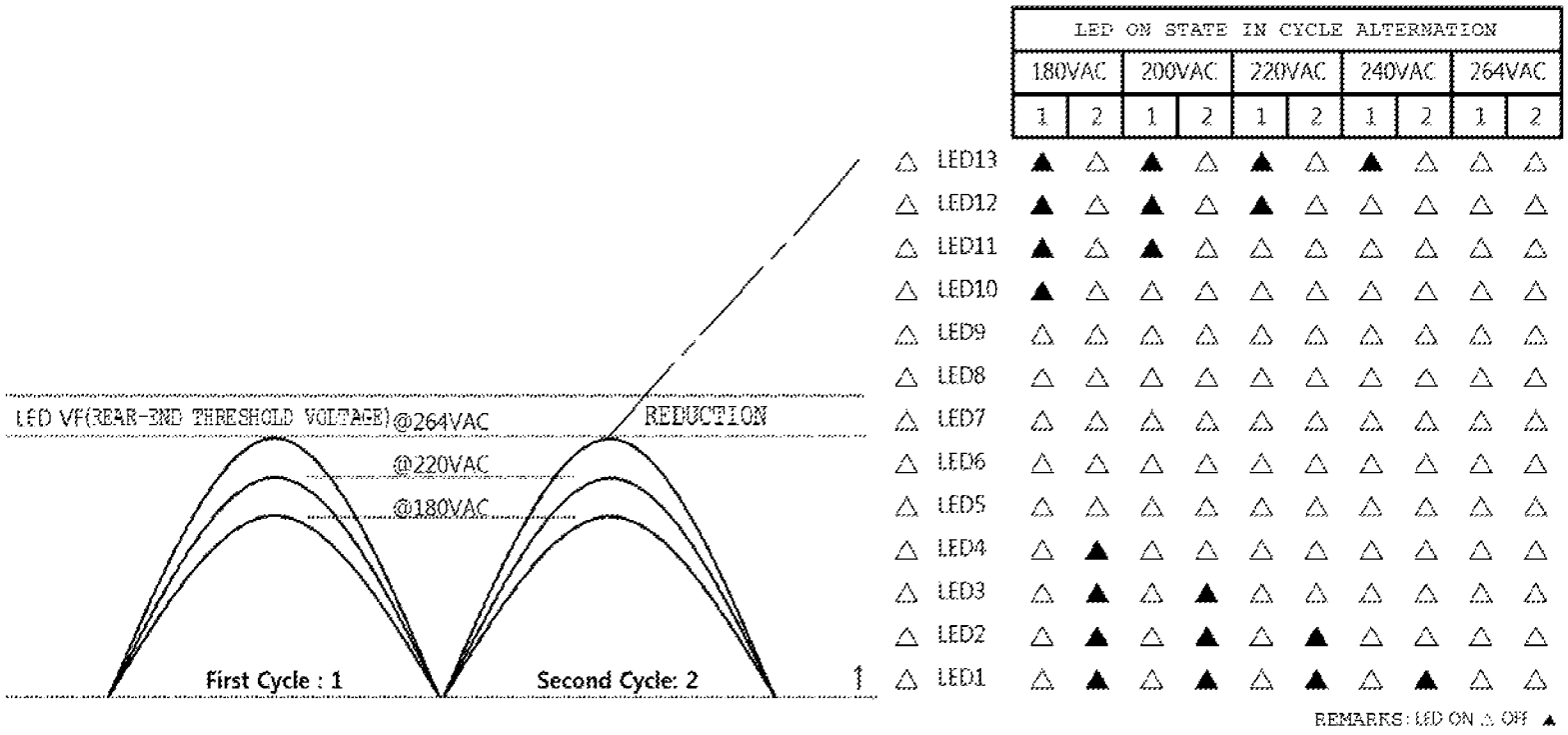
FIG. 6 is a conceptual view showing that a loss in the voltage of rear-end LED lamps becomes zero in alternating cycles of a voltage waveform in a second embodiment of the present invention [(a) of FIG. 6] and an explanatory view showing LED lamp ON and OFF states in a first cycle and a second cycle of the alternating cycles [(b) of FIG. 6]
Figure 7:
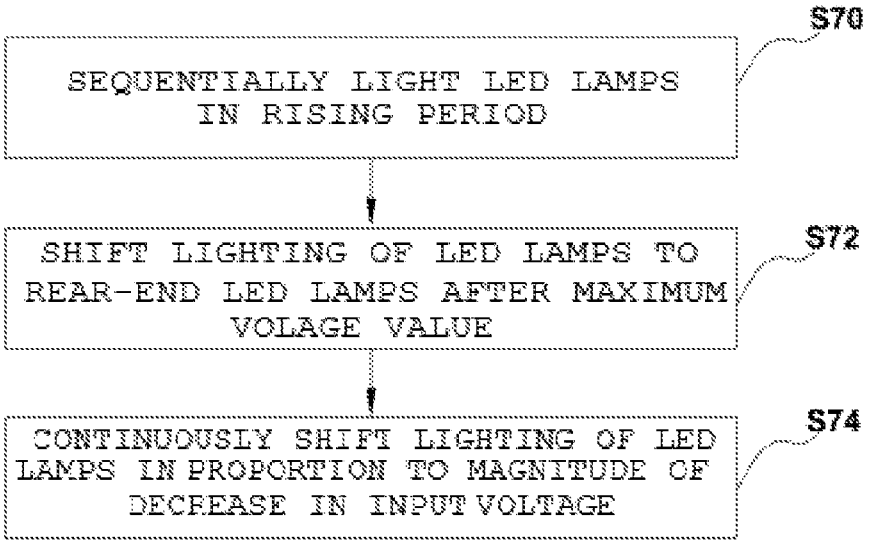
FIG. 7 is a flowchart showing an ultra-high efficiency LED lamp driving method according to a first embodiment of the present invention.
Figure 8:
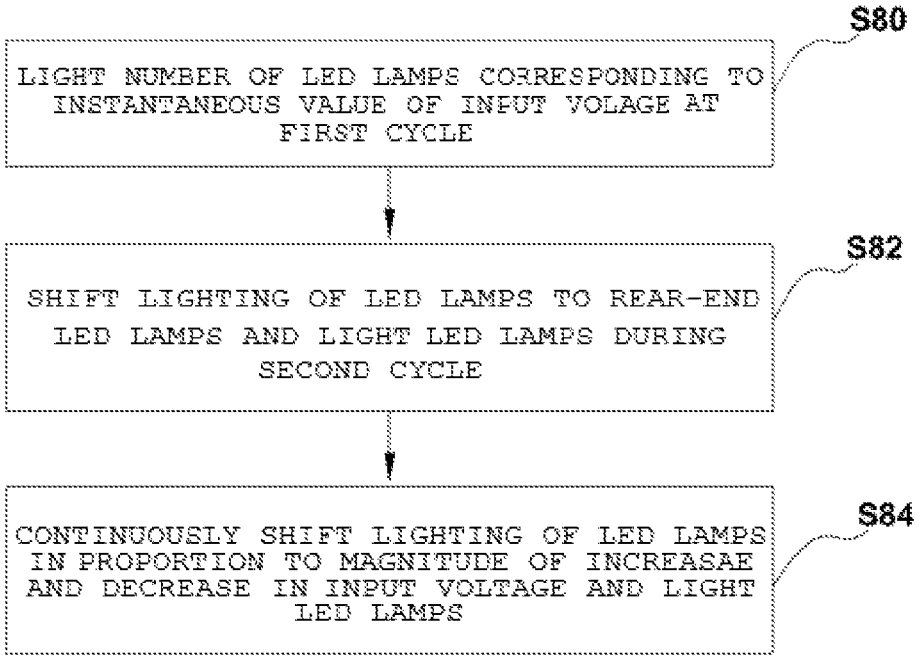
FIG. 8 is a flowchart showing an ultra-high efficiency LED lamp driving method according to a second embodiment of the present invention.

A second embodiment shown in FIGS. 6 and 8 is basically identical to the first embodiment.

However, the second embodiment is different from the first embodiment in that shift lighting to the rear-end LED lamps is performed at a falling time in a certain cycle according to the first embodiment while shift lighting to the rear-end LED lamps is performed at one selected from between a first cycle and a second cycle, which are sequentially repeated, e.g. the second cycle, according to the second embodiment.

In addition, the second embodiment is different from the first embodiment in that a trigger signal is output when the trigger output unit 31 senses the maximum value of the input voltage according to the first embodiment whereas a trigger signal is output when transition from the first cycle to the second cycle, i.e. an input voltage of zero, is sensed according to the second embodiment.

The method according to the second embodiment is a method of performing shift lighting of the LED lamps to the rear end of the LED lamps connected in series through cycle alternation when full-wave rectified input voltage has a phase angle of 180 degrees and is operated at a predetermined frequency (for example, 120 Hz).

At the first cycle of the alternating cycles, a number of LED lamps corresponding to the instantaneous value of the input voltage are lit in the manner in which the LED lamps are turned off in the order that is reverse to the lighting sequence at the rising time (in a non-sequential manner). At the second cycle, lighting of the LED lamps is shifted to the rear end of the LED lamps connected in series such that a number of LED lamps corresponding to the instantaneous value of the input voltage, including the LED lamps that were not lit at the first cycle, are shifted and lit and such that the LED lamps are sequentially shifted and lit in proportion to the magnitude of decrease in input voltage.

The total operating threshold voltages Total LED VF of the LED lamps are set to be equal to or higher than (preferably higher than) the maximum value Vmax of the AC input voltage within the upper limit value in variation of the input voltage, in the same manner as in the first embodiment.

During the first cycle of the alternating cycles of the full-wave rectified voltage (the first cycle of FIG. 6), a step (S80) of lighting a number of LED lamps corresponding to the instantaneous value of the input voltage that increases and decreases beginning from the front end of the LED lamps in the manner in which the LED lamps are turned off in the order that is reverse to the lighting sequence at the rising time (in a non-sequential manner) is performed, which is identical to what has been described in the section "Background Art" and therefore a detailed description thereof will be omitted.

Since the total operating threshold voltages Total LED VF of the LED lamps are set to be equal to or higher than (preferably higher than) the maximum value Vmax of the AC input voltage within the upper limit value in variation of the input voltage at the first cycle, however, there are LED lamps LED1, . . . , and LED13 that are not lit depending on the input voltage value.

When the input voltage is 180 VAC (@180 VAC), as shown in FIG. 6, only the operating switches ranging from the first operating switch LS1 to the ninth operating switch LS9 operate to light only the LED lamps ranging from the first LED lamp LED1 to the ninth LED lamp LED9 at both the rising time and the falling time of the first cycle, and the remaining LED lamps, i.e. the LED lamps ranging from the tenth LED lamp LED10 to the thirteenth LED lamp LED13, are not lit. At the rising time, the LED lamps are lit in the order of the first LED lamp LED1→the second LED lamp LED2→ . . . →the ninth LED lamp LED9. At the falling time, the LED lamps are turned off in the order that is reverse to the lighting sequence (turned off in a non-sequential manner).

When the input voltage is 200 VAC (@200 VAC), the operating switches ranging from the first operating switch LS1 to the tenth operating switch LS10 operate to light only the LED lamps ranging from the first LED lamp LED1 to the tenth LED lamp LED10 at both the rising time and the falling time of the first cycle, and the remaining LED lamps, i.e. the LED lamps ranging from the eleventh LED lamp LED11 to the thirteenth LED lamp LED13, are not lit.

When the input voltage is 220 VAC (@220 VAC), the operating switches ranging from the first operating switch LS1 to the eleventh operating switch LS11 operate to light only the LED lamps ranging from the first LED lamp LED1 to the eleventh LED lamp LED11 at both the rising time and the falling time of the first cycle, and the remaining LED lamps, i.e. the twelfth LED lamp LED12 and the thirteenth LED lamp LED13, are not lit.

When the input voltage is 240 VAC (@240 VAC), the operating switches ranging from the first operating switch LS1 to the twelfth operating switch LS12 operate to light only the LED lamps ranging from the first LED lamp LED1 to the twelfth LED lamp LED12 at both the rising time and the falling time of the first cycle, and the thirteenth LED lamp LED13 is not lit.

Now, the shift of lighting to the rear-end LED lamps at the second cycle of the alternating cycles will be described.

During the second cycle of the alternating cycles of the full-wave rectified AC input voltage, a step (S82) of skipping a number of front-end LED lamps corresponding to the number of rear-end LED lamps that were not lit at the first cycle of the alternating cycles in the rear-end direction in order to shift lighting of the LED lamps to the rear end of the LED lamps connected in series such that a number of LED lamps corresponding to the instantaneous value of the input voltage that increases and decreases beginning from the rear-end LED lamps that were not lit at the first cycle are lit and a step (S84) of sequentially shifting lighting of the LED lamps in the rear-end direction in proportion to the magnitude of increase and decrease in input voltage and lighting the LED lamps are performed.

That is, when the AC input voltage becomes zero, lighting of the LED lamps is shifted to the rear-end direction, with the result that a number of LED lamps corresponding to the instantaneous value of the input voltage beginning from the rearmost LED lamp, i.e. the thirteenth LED lamp LED13, are lit.

For example, when the input voltage is 180 VAC (@180 VAC), the LED shift controller 30 shifts lighting of the LED lamps to the rear-end LED lamp, i.e. the thirteenth LED lamp LED13. When the voltages of the LED lamps beginning from the rearmost LED lamp, i.e. the thirteenth LED lamp LED13, reach operating threshold voltages corresponding to the instantaneous value of the input voltage, the thirteenth LED lamp LED13→the twelfth LED lamp LED12→ . . . →the fifth LED lamp LED5 are sequentially lit at the rising time, the fifth LED lamp LED5→the sixth LED lamp LED6→ . . . →the thirteenth LED lamp LED13 are sequentially turned off at the falling time, and the remaining LED lamps, i.e. the LED lamps ranging from the fourth LED lamp LED4 to the first LED lamp LED1, are not lit.

When the input voltage is 200 VAC (@200 VAC), the LED shift controller 30 shifts lighting of the LED lamps to the rear-end LED lamp, i.e. the thirteenth LED lamp LED13. When the voltages of the LED lamps beginning from the rearmost LED lamp, i.e. the thirteenth LED lamp LED13, reach operating threshold voltages corresponding to the instantaneous value of the input voltage, the thirteenth LED lamp LED13→the twelfth LED lamp LED12→ . . . →the fourth LED lamp LED4 are sequentially lit at the rising time, the fourth LED lamp LED4→the fifth LED lamp LED5→ . . . →the thirteenth LED lamp LED13 are sequentially turned off at the falling time, and the remaining LED lamps, i.e. the LED lamps ranging from the third LED lamp LED3 to the first LED lamp LED1, are not lit.

In the same manner, when the input voltage is 220 VAC (@220 VAC), the LED shift controller 30 shifts lighting of the LED lamps to the rear-end LED lamp, i.e. the thirteenth LED lamp LED13. When the voltages of the LED lamps beginning from the rearmost LED lamp, i.e. the thirteenth LED lamp LED13, reach operating threshold voltages corresponding to the instantaneous value of the input voltage, the thirteenth LED lamp LED13→the twelfth LED lamp LED12→ . . . →the third LED lamp LED3 are sequentially lit at the rising time, the third LED lamp LED3→the fourth LED lamp LED4→ . . . →the thirteenth LED lamp LED13 are sequentially turned off at the falling time, and the remaining LED lamps, i.e. the second LED lamp LED2 and the first LED lamp LED1, are not lit.

In addition, when the input voltage is 240 VAC (@240 VAC), the LED shift controller 30 shifts lighting of the LED lamps to the rear-end LED lamp, i.e. the thirteenth LED lamp LED13. When the voltages of the LED lamps beginning from the rearmost LED lamp, i.e. the thirteenth LED lamp LED13, reach operating threshold voltages corresponding to the instantaneous value of the input voltage, the thirteenth LED lamp LED13→the twelfth LED lamp LED12→ . . . →the second LED lamp LED2 are sequentially lit at the rising time, the second LED lamp LED2→the third LED lamp LED3→ . . . →the thirteenth LED lamp LED13 are sequentially turned off at the falling time, and the remaining LED lamp, i.e. the first LED lamp LED1, is not lit.

As shown in FIG. 6, therefore, it can be seen that there are LED lamps that are not lit depending on the input voltage value. The reason for this is that the total operating threshold voltages Total LED VF of the LED lamps are set to be equal to or higher than the maximum value Vmax of the AC input voltage within the upper limit value in variation of the input voltage in order to make a loss of the input power zero, as described above.

Therefore, the second embodiment of the present invention is characterized in that LED lamps that are not lit at the first cycle are lit at the second cycle and in that LED lamps that are not lit at the second cycle are lit at the first cycle.

Now, the control operation at the second cycle will be described in detail.

The second embodiment is basically identical to the first embodiment. However, the second embodiment is different from the first embodiment in that a trigger signal is output when the trigger output unit 31 senses the maximum value of the input voltage according to the first embodiment, whereas a trigger signal is output when the input voltage becomes zero according to the second embodiment, as described above.

When the input voltage reaches zero voltage, the trigger output unit 31 senses the same and outputs a trigger signal to the LED shift unit 32.

Upon receiving the trigger signal from the trigger output unit 31, the LED shift unit 32 outputs a switching signal to the shift switches and at the same time receives the rear-end voltage Vfb of the rear-end LED lamp, i.e. the thirteenth LED lamp LED13, from the rear-end voltage monitoring unit 33.

Upon receiving the trigger signal, the LED shift unit operates the shift switches. The LED shift unit 32 sequentially outputs a switching signal to the shift switches beginning from the thirteenth LED lamp LED13 at the rising time and sequentially outputs a switching signal to the shift switches in the reverse order at the falling time in order to turn on and turn off the LED lamps as described above.

If the rear-end voltage Vfb, which is a monitored voltage value, is not detected [if the rear-end voltage Vfb is lower than the reference voltage value Vref] in the switching process, the shift switches are switched at a very fast speed without delay. If the detected rear-end voltage Vfb is equal to or higher than the reference voltage value Vref (0.2 V in the above example), control is performed such that a time at which the next shift switch is switched on is delayed. That is, a time interval during which the corresponding shift switch remains on is maintained long such that the lit state of the corresponding LED lamp is maintained for a predetermined interval, in the same manner as in the first embodiment.

Although the exemplary embodiments of the present invention have been described as above, it will be apparent to those skilled in the art that the present invention may be embodied into other specific forms without departing from the spirit or scope of the present invention, in addition to the previously described embodiments.

However, it should be understood that the above-described embodiments are not restrictive but illustrative, and therefore the present invention may be modified within the scope of the appended claims and their equivalents.

The invention claimed is:

1. An ultra-high efficiency LED lamp driving device comprising:

a rectification unit for rectifying alternating current input power;

a plurality of LED lamps configured to be lit by the power rectified by the rectification unit;

a plurality of operating switches connected to tabs between the LED lamps for sequentially lighting the LED lamps when the voltages of the LED lamps reach driving threshold voltages as a voltage of the alternating current input power increases;

a plurality of shift switches connected to tabs between the LED lamps; and a LED shift controller for operating the shift switches wherein operating threshold voltage values of all of the LED lamps are equal to or higher than a maximum value (Vmax) of input voltage of the alternating current input power wherein determining the LED lamps that were not lit during a voltage rising time of rectified voltage or during a first cycle of alternating cycles of the rectified voltage, wherein skipping a number of front-end LED lamps corresponds to a number of rear-end LED lamps that were not lit during the voltage rising time or during the first cycle of the alternating cycles are skipped in a rear-end direction, wherein shifting the lighting of the LED lamps to a rear end of the LED lamps connected in series during a voltage falling time or during a second cycle of the alternating cycles of the rectified voltage in order to sequentially light LED lamps ranging from the rear-end LED lamps that were not lit during the voltage rising time or during the first cycle to LED lamps corresponding to an instantaneous value of the input voltage, wherein the LED shift controller comprises:

a trigger output unit configured for sensing a trigger voltage value of the input voltage and outputting a trigger signal; and an LED shift unit configured for skipping a number of front-end LED lamps and outputting a switching signal to the shift switches for shifting the lighting of the LED lamps to the rear end of the LED lamps connected in series when the trigger signal is received from the trigger output unit, wherein the skipped number of front-end LED lamps equals the number of rear-end LED lamps that were unlit at the voltage rising time or at the second cycle of the alternating cycles in the rear-end direction;

wherein when the operating threshold voltage values of all of the LED lamps are equal to or higher than the maximum value (Vmax) of the input voltage of the alternating current input power and at least one LED lamp is unlit beginning from a rearmost LED lamp, sequentially lighting the LED lamps ranging from the rear-end LED lamps that were unlit during the voltage rising time according to a cycle of the rectified voltage or during the first cycle of the alternating cycles of the rectified voltage to LED lamps corresponding to the instantaneous value of the input voltage.

2. The ultra-high efficiency LED lamp driving device according to claim 1, wherein the trigger output unit senses the maximum value of the input voltage and outputs a trigger signal, and the LED shift unit operates the shift switches to skip at least one front-end LED lamp during the voltage falling time such that lighting of the LED lamps is shifted to a rear end thereof when the trigger signal is received from the trigger output unit and when the operating threshold voltage values of all of the LED lamps are equal to or higher than the maximum value of the input voltage of the alternating current input power in order to light the LED lamps that were not lit during the voltage rising time according to a cycle of the rectified voltage.

3. The ultra-high efficiency LED lamp driving device according to claim 1, wherein the trigger output unit senses a zero voltage value of the input voltage and outputs a trigger signal, and the LED shift unit operates the shift switches during the second cycle of alternating cycles such that lighting of the LED lamps is shifted to the rear end thereof when the trigger signal is received from the trigger output unit and when the operating threshold voltage values of all of the LED lamps are equal to or higher than the maximum value (Vmax) of the input voltage of the alternating current input power in order to light the LED lamps that were not lit during the first cycle of the alternating cycles of the rectified voltage.

4. The ultra-high efficiency LED lamp driving device according to claim 1, further comprising: a rear-end voltage monitoring unit for monitoring a rear-end voltage of an LED lamp that is located at a rearmost end of the LED lamps and outputting monitored rear-end voltage (Vfb) to the LED shift unit, wherein when the rear-end voltage detected by the rear-end voltage monitoring unit is equal to or higher than a reference voltage value (Vref), the LED shift unit delays shifting to a next shift switch.

* * * * *